US009033724B2

(12) United States Patent
Lai et al.

(10) Patent No.: US 9,033,724 B2
(45) Date of Patent: May 19, 2015

(54) CARD EDGE CONNECTOR

(71) Applicant: GIGA-BYTE TECHNOLOGY CO., LTD., New Taipei (TW)

(72) Inventors: Chih Ming Lai, New Taipei (TW); Yung Shun Kao, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 21 days.

(21) Appl. No.: 13/732,361

(22) Filed: Dec. 31, 2012

(65) Prior Publication Data

US 2013/0260591 A1 Oct. 3, 2013

(30) Foreign Application Priority Data

Apr. 3, 2012 (TW) ..... 101111831 A
Jun. 27, 2012 (TW) ..... 101123075 A

(51) Int. Cl.

*H01R 13/62* (2006.01)
*H01R 13/627* (2006.01)
*H01R 12/70* (2011.01)
*H01R 12/72* (2011.01)

(52) U.S. Cl.

CPC ..... *H01R 13/6271* (2013.01); *H01R 12/7029* (2013.01); *H01R 12/721* (2013.01)

(58) Field of Classification Search

USPC ..... 439/328, 329, 157, 630
IPC ..... H01R 23/7005,23/7068, 23/682, 12/79, H01R 13/6275, 13/62938, 13/62955; H05K 7/1405; G06K 7/0021, 13/08
See application file for complete search history.

(56) References Cited

U.S. PATENT DOCUMENTS

| | | | | |
|---|---|---|---|---|
| 5,112,242 | A * | 5/1992 | Choy et al. | 439/326 |
| 5,211,568 | A * | 5/1993 | Yamada et al. | 439/157 |
| 5,647,755 | A * | 7/1997 | Hida et al. | 439/328 |
| 5,820,396 | A * | 10/1998 | Pan et al. | 439/328 |
| 6,743,028 | B2 * | 6/2004 | Wang | 439/92 |
| 7,892,006 | B2 * | 2/2011 | Guan et al. | 439/328 |

FOREIGN PATENT DOCUMENTS

| | | |
|---|---|---|
| TW | 308368 A | 6/1997 |
| TW | M367483 | 10/2009 |

* cited by examiner

*Primary Examiner* — Hien Vu
(74) *Attorney, Agent, or Firm* — Chun-Ming Shih

(57) ABSTRACT

A card edge connector includes a body and two latches. The body includes a base and two columns. The base includes an insertion slot formed thereon, and the two columns are disposed on the base and located two opposite ends of the base. Each of the columns includes a trench connecting to the insertion slot. Two latches are respectively disposed to the two columns. Each of the fasten portions fixes one of the latches to the corresponding column, such that an elastic arm of the latch suspends in the trench of the corresponding column. The elastic arm includes an engaging portion for moving back and forth relative to the column in the trench. When a circuit board inserts into the insertion slot of the body, the engaging portions of the latches clamp the circuit board, so as to prevent the circuit board from escaping from the card edge connector.

10 Claims, 18 Drawing Sheets

CARD EDGE CONNECTOR

CROSS-REFERENCES TO RELATED APPLICATIONS

This non-provisional application claims priority under 35 U.S.C. §119(a) on Patent Application No. 101111831 filed in Taiwan, R.O.C. on 2012 Apr. 3 and Patent Application No. 101123075 filed in Taiwan, R.O.C. on 2012 Jun. 27, the entire contents of which are hereby incorporated by reference.

BACKGROUND

1. Field of the Invention

This disclosure relates to electrical connectors, and more particularly, to a card edge connector.

2. Related Art

The card edge connector is a widely used electrical connection interface in a main board of an electronic device, and an expansion component configured with a circuit board, such as a memory module or an interface card, inserts into the card edge connector. The card edge connector is an electrical conjunction between such a function expansion component and the main board, so as to expand or enhance function of the electronic device.

An ordinary card edge connector includes a long and narrow insulation body and two latches. The insulation body includes an insertion slot extending in a long lateral. The two latches respectively connect to two opposite ends of the insulation body along the longitudinal axis of the insulation body. One end of the latch pivots to the insulation body while the other end of the latch is able to swivel back and forth with respect to the insulation body. On the side facing the insertion slot of each latch, a bump is formed thereon.

Practically, two notches are respectively disposed on two opposite edges of the circuit board of the expansion component. Two notches are provided for the bumps of the two latches to engage thereinto. Therefore, when the expansion component inserts into the insertion slot of the insulation body, the latches swivel toward the circuit board and the bumps engage into notches on two opposite edges of the circuit board, so as to fix the expansion component on the insulation body.

Regarding to the card edge connector as aforementioned, the latches swivel to lock and fix the expansion component. Some space in the electronic device or on the main board has to be reserved for the latches to swivel back and forth, so as to ensure that the bumps can be completely removed from the corresponding notches; or the movement of the latches are restricted and keep on fixing the expansion component and the expansion component can not be detached from the insulation body.

Since the aforementioned type of card edge connector requires enough space inside of the electronic device to work properly, it is difficult to realize the miniaturization of the electronic device.

SUMMARY OF THE INVENTION

In view of the above problems, this disclosure provides a card edge connector. The card edge connector of this disclosure solve the problem that the card edge connector in the art requires enough reserved space to work properly and causes the difficulty in miniaturization progress of the electronic device.

At least one embodiment of this disclosure discloses a card edge connector, which includes a body and two latches. The body includes a base and two columns. The base includes an insertion slot formed thereon and extending along a first direction. the two columns are disposed on the base and located in the first direction, and are respectively located at a position corresponding to two opposite ends of the insertion slot of the base, and each of the two columns includes a trench corresponding to the insertion slot and the trench on a lateral surface, corresponding to the slot, of the column. Two latches are respectively disposed to the two columns. Each of the latches includes at least one fasten portions and an elastic arm connecting to the fasten portion. The fasten portion is fixed to the column, and the elastic arm suspends in the trench. The elastic arm includes an engaging portion on a lateral surface, corresponding to the insertion slot, of the elastic arm, and the engaging is applicable to move back and forth with respect to the column in the first direction.

Through the card edge connector disclosed in this disclosure, the movement of the elastic arms of the two latches is parallel to the longitudinal axis of the base of the body, and each latch moves within corresponding column to fix or release the expansion device. Since the latches move within the body, the latches do not occupy unnecessary space outside the body. Beside that the user does not need to press or rotate the latches when fixing or removing the expansion component, the user can directly push to insert the expansion component into the card edge connector or pull to remove the expansion device from the card edge connector, so as to simplify the installation process for the expansion component. Furthermore, through fasten portions of the two latches penetrating the body, when installing the card edge connector to the main board, the body of card edge connector is fixed to the main board by inserting the fasten portions of the two latches into holes on the main board. The card edge connector is precisely fixed at the pre-determined position on the main board, and the mechanical stability of card edge connector is also enhanced.

BRIEF DESCRIPTION OF THE DRAWINGS

The present invention will become more fully understood from the detailed description given herein below for illustration only, and thus not limitative of the present invention, wherein.

DETAILED DESCRIPTION OF THE INVENTION

Figure 1:
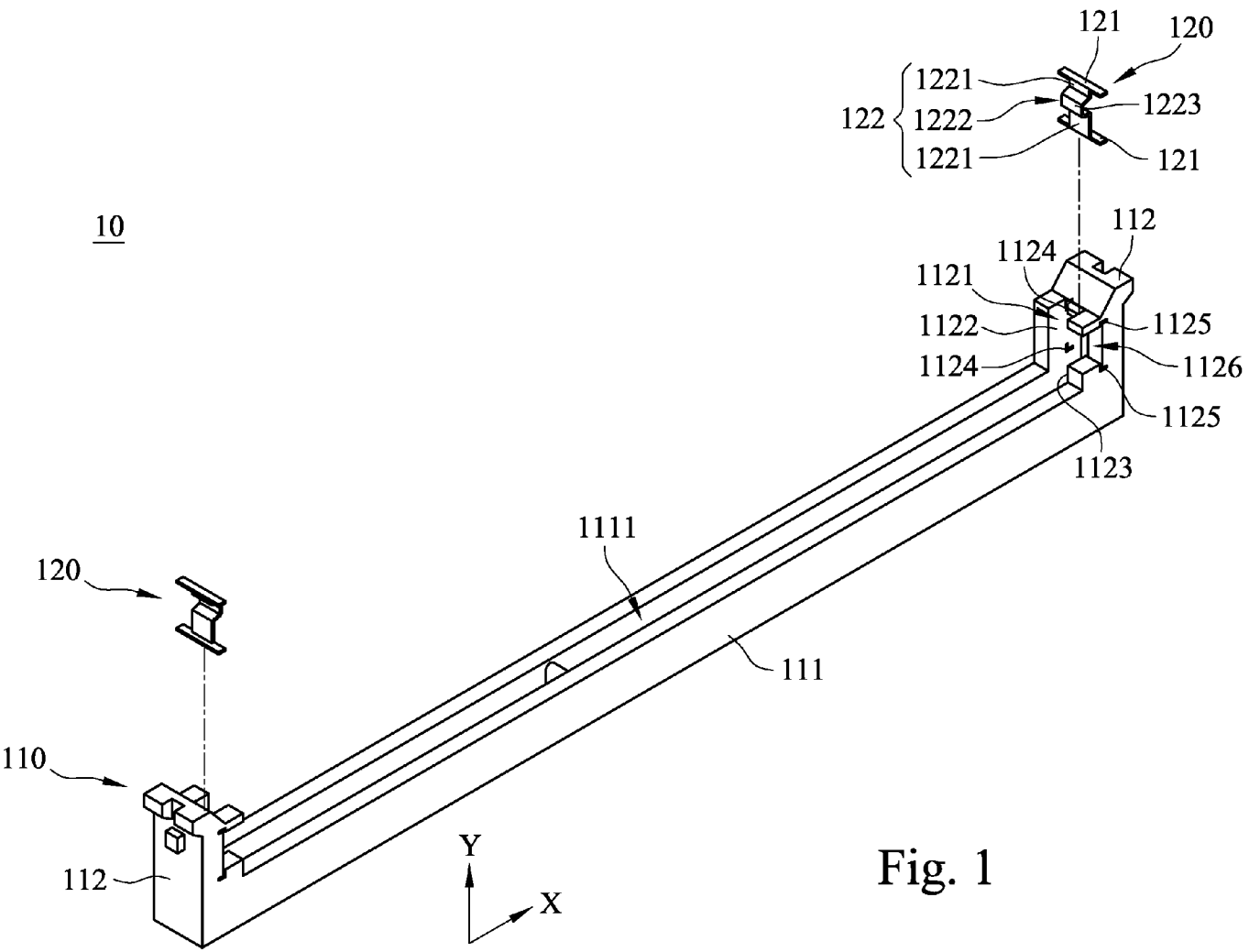
FIG. 1 is an explosive view of the first embodiment.
Figure 2:
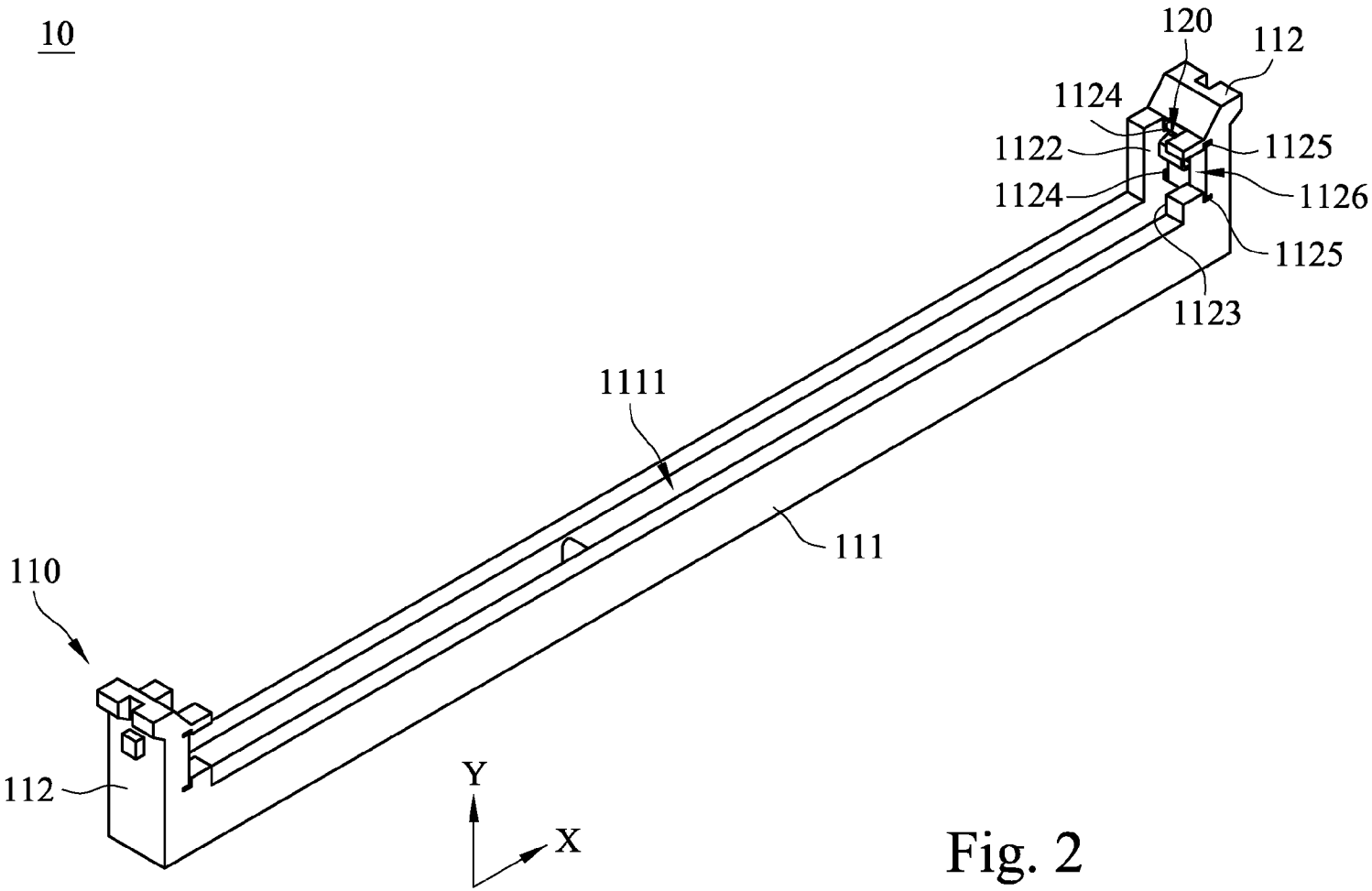
FIG. 2 is a perspective view of the first embodiment.
Figure 3:
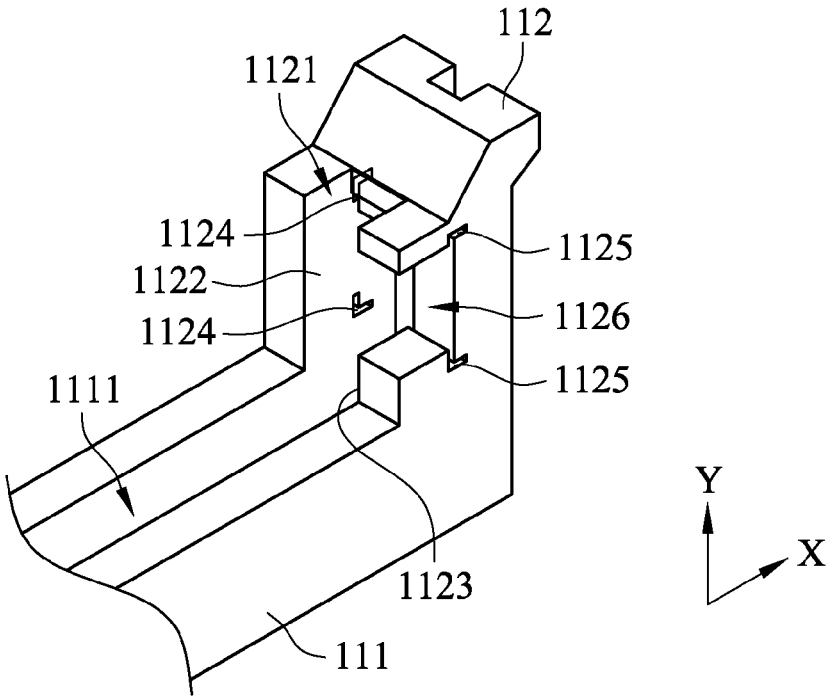
FIG. 3 is a partial enlarged view of FIG. 1.
Figure 4:
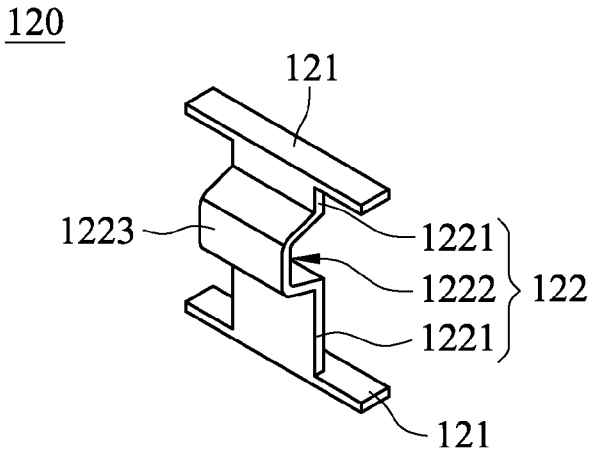
FIG. 4 is a perspective view of the latch according to the first embodiment.
Figure 5A:
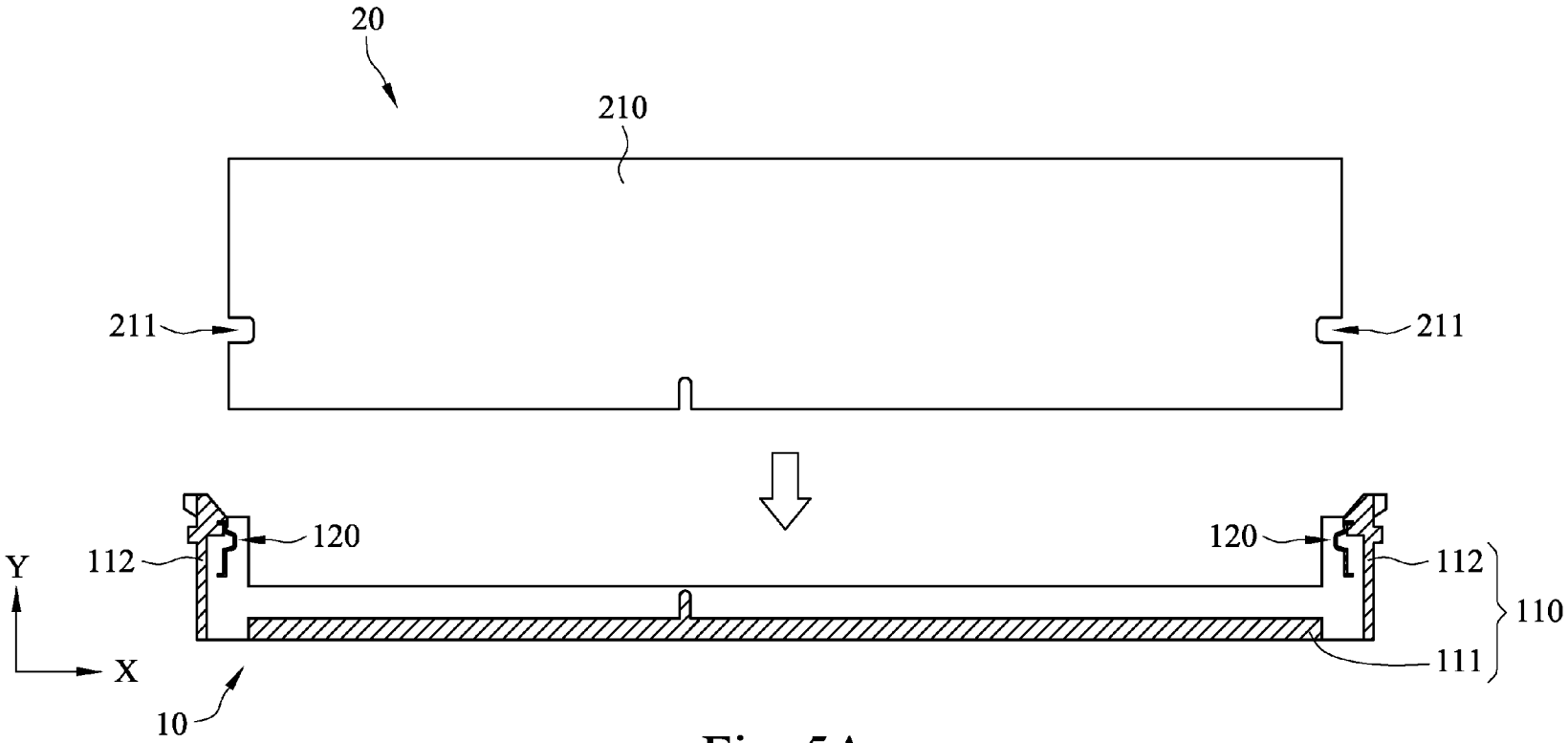
FIG. 5A to FIG. 5C are schematic views illustrating operation of the first embodiment.
Figure 5B:
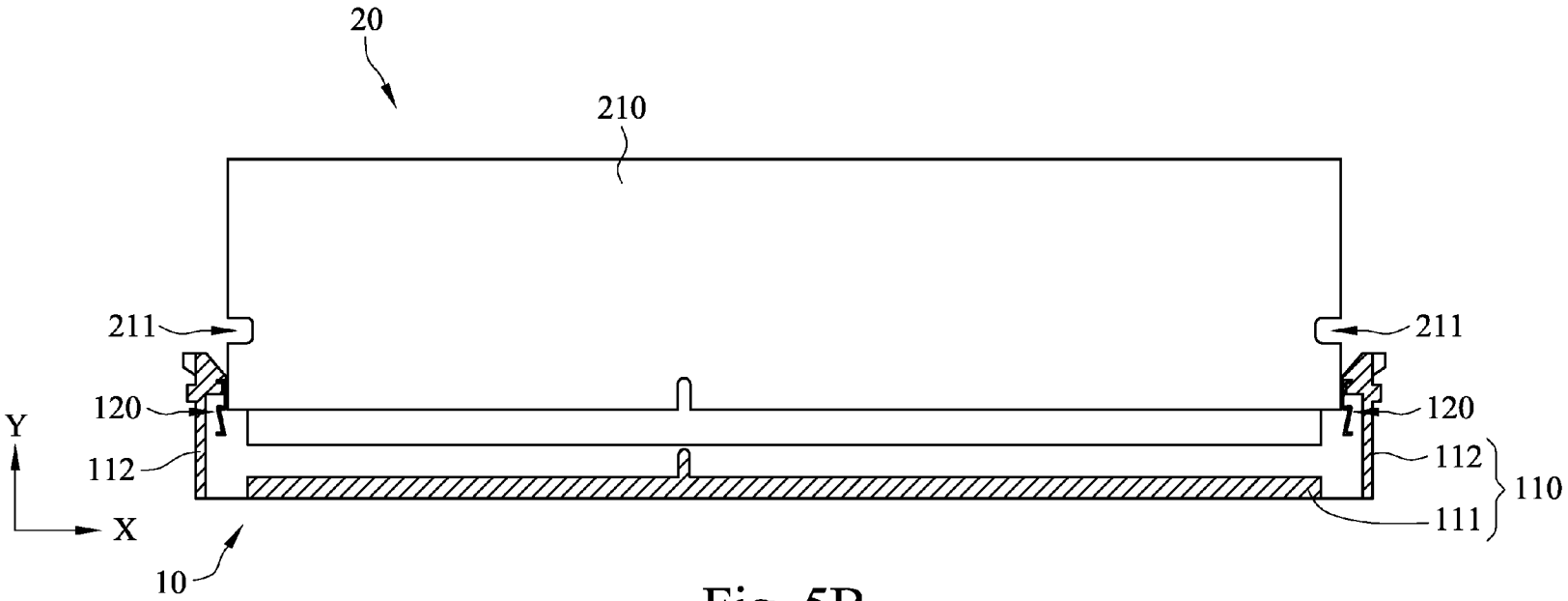
Figure 5C:
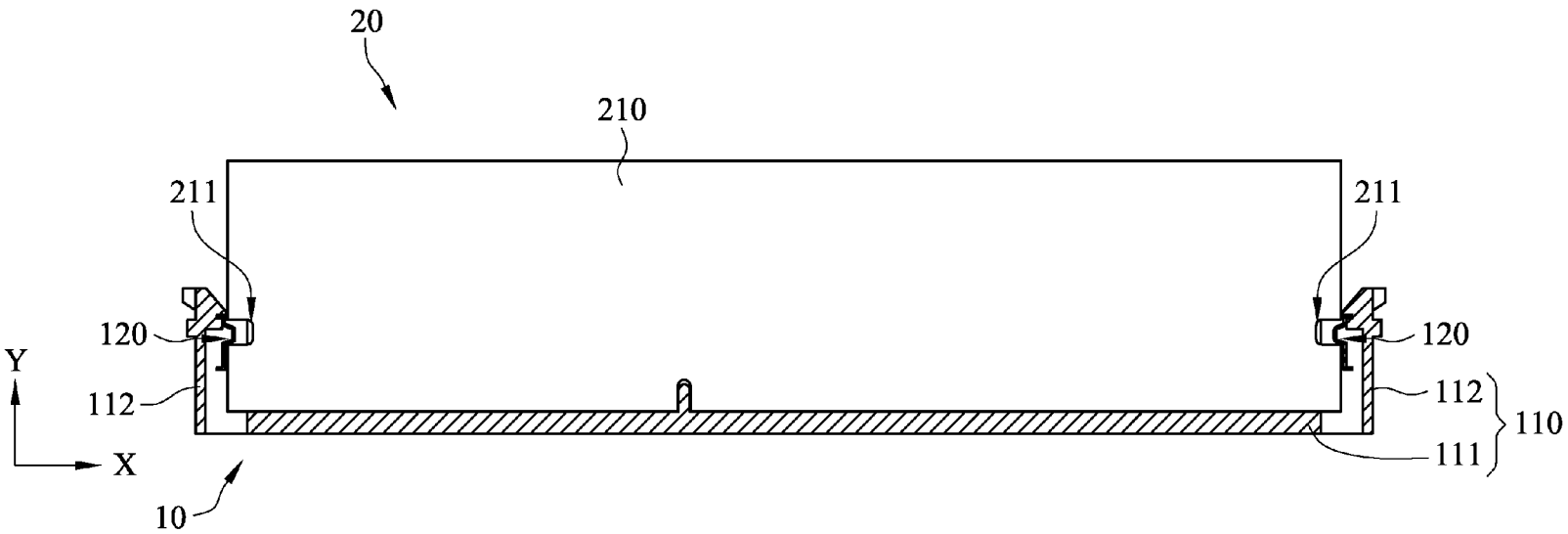

Referring to FIG. 1 to FIG. 4, the card edge connector 10 according to a first embodiment includes a body 110 and two latches 120. The body 110 is, but not limited to, monolithically made of insulation material. The body 110 includes a base 111 and two columns 112. The base 111 is, but not limited to, a long-narrow shaped structure. The base 111 includes an insertion slot 1111 and the insertion slot 1111 is depressed on the upper surface of the base 111. Furthermore, the insertion slot 1111 extends along a first direction x which is parallel to a longitudinal axis of the base 111.

The two columns 112 are disposed on the surface which the insertion slot 1111 is formed thereon. The two columns 112 are located in the first direction x, spaced by the insertion slot and respectively located adjacent to each end of the insertion slot 1111. Each of the columns 112 includes a trench 1121 formed on a surface adjacent to the insertion slot 1111. Each of the trenches 1121 extends toward the base 111 in a second direction y to connect to the insertion slot 111. The first direction x and the second direction y are intersect, for example, the first direction x is perpendicular to the second direction y, or an included angle less than 90 degree are defined by the two directions. Each of the columns 112 includes a first wall surface 1122 and a second wall surface 1123 facing each other with the trench 1121 located therebetween. Two assembling holes 124 are formed on the first wall surface 1122, and two assembling holes 124 are disposed in the second direction y and spaced from each other. Two assembling holes 1125 are disposed on the second wall surface 1123 and pass through the column 112. The assembling holes 1125 on the second wall surface 1123 are paired with a corresponding assembling hole 1124 on the first wall surface 1122. Furthermore, an opening 1126 is disposed on the column 112, and the opening 1126 is located among the two assembling holes 1125 and connects to the trench 1121 and the exterior.

Referring to FIG. 1 to FIG. 4, the two latches 120 of the card edge connector 10 are respectively disposed on the two columns 112 of the body 110. Each of the latches 120 includes two fasten portions 121 and an elastic arm 122. The latch 120 or at least the elastic arm 122 thereof is made of material having elastic recovery property, for example, the elastic recovery material is plastic, rubber, metal . . . etc. In this embodiment, the latch 120 formed monolithically and made of metal is taken as an illustration, and the implement is not limited thereto. The elastic arm 122 of the latch 120 connects to the two fasten portions 121. The width of each fasten portion 121 is larger than the width of the elastic arm 122, such that two opposite ends of each fasten portion 121 protrude from two opposite edges of the elastic arm 122 respectively. The elastic arm 122 includes two straight portions 1221 and an engaging portion 1222. Two straight portions 1221 connects to the two fasten portions respectively. The engaging portion 1222 connects to the two straight portions 1221 and located therebetween. The engaging portion 1222 is, but not limited to, a bent structure extending from the surface of the corresponding straight portion 1221, such that a guiding surface 1223 is formed on the engaging portion 1222 and the guiding surface is a curved surface or an inclined surface.

The latch 120 is assembled to the column 112 through the two assembling holes 1125 on the second wall surface 1123 and the opening 1126 of the column 112. Two fasten portions 121 respectively pass through two assembling holes 1125 on the second wall surface 1123, the elastic arm 122 passes through the opening 1126 of the column 112, such that two ends of the fasten portion 121 insert into a pair of assembling holes 1124 on the first wall surface 1122 and the assembling holes 1125 on the second wall surface 1123. Therefore, the elastic arm 122 connects to the two fasten portions 121 in the second direction y and located between the two fasten portions 121. And the elastic arm 122 suspends in the trench 1121 of the column 112. The two fasten portions 121 are, but not limited to, fixed in corresponding assembling holes 1124, 1125 by tight fit. The width of the elastic arm 122 is smaller or equaled to the width of the trench 1121 of the column 112. When external force apply to the elastic arm 122, the elastic arm 122 deforms toward the trench 1121 in the first direction x, so as to drive the engaging portion to move back and forth in the trench 1121 in the first direction x.

In one example of this disclosure, the card edge connector fixes a memory module, and the card edge connector is not limited to use to fix the memory module. Furthermore, a plurality of electrical pins is disposed in the base 111 of the card edge connector 10 and electrically connecting to the main board. When the memory module inserts into the card edge connector 10, the memory module is fixed on the main module and electrically connects to the main board via the card edge connector 10. The electrical pins are known by a person having ordinary skill in the art, such that the detailed description of the electrical pins is omitted hereinafter.

Referring to FIG. 1, FIG. 3, and FIG. 5A to FIG. 5C, the expansion component 20 includes a circuit board 210, and each of the opposite edges of the circuit board 210 includes a notch 211 formed thereon. When the expansion component 20 inserts into the card edge connector 10, two opposite edges of the circuit board 210 respectively embed into trenches 1121 of the columns 112 and then the circuit board 210 is guided by the trenches 1121 to insert into the insertion slot 1121. Meanwhile, the opposite edges of the circuit board 210 respectively press against the engaging portions 1222 of the two latches 120. When the circuit board 210 moves toward the insertion slot 1111 of the base 111, the opposite edges of the circuit board 210 push the engaging portion 1222 by pressing against the guiding surface 1223 thereof and the circuit board 210 is guided by the guiding surface 1223 to move toward the insertion slot 1111, such that the elastic arm 122 deforms to drive the engaging portion to move toward the bottom of the trench 1121 in the first direction x.

After the circuit board 210 inserts into the insertion slot 1111 of the base 111, the notches 211 of the opposite edges of the circuit board 210 are located corresponding to the engaging portions 1222 of the elastic arms 122. At this time, since force applied to the engaging portions 1222 is removed, the engaging portions 1222 reset to the original positions by elastic recovery force of the elastic arms 122 and the engaging portions 1222 respectively engages into the notches 211 of the circuit board 210. By the restriction of the two latches 120, the circuit board 210 is not able to escape from the card edge connector 10. Similarly, when the detaching the expansion component 20 from the card edge connector 10, the opposite edges of the circuit board 210 push the engaging portions 1222 of the elastic arms 122 when pulling the expansion component 20, the engaging portions 1222 move toward the bottom of the trench 1121 again to escape from the notches 211 of the circuit board 210. Guided by the guiding surfaces 1223 of the engaging portions 1222, the opposite edges of the circuit board 210 slide along the second direction y, and the expansion component 20 escapes from the card edge connector 10.

When the expansion component 20 inserts into the card edge connector 10, the expansion component 20 is restricted or released by the engaging portions 1222 moving parallel to the longitudinal axis of the base 110 reciprocally, the latches are not required to be pressed or rotated by the user when inserting the expansion component into the card edge connector or pulling the expansion component away from the card edge connector, therefore the installation procedure of the expansion component is simplified. Beside, reserved space inside the electronic device for rotating or swiveling the latch is not required anymore, space usage efficiency inside the electronic device is improved and it becomes easier to minimize the size of the electronic device.

Figure 6:
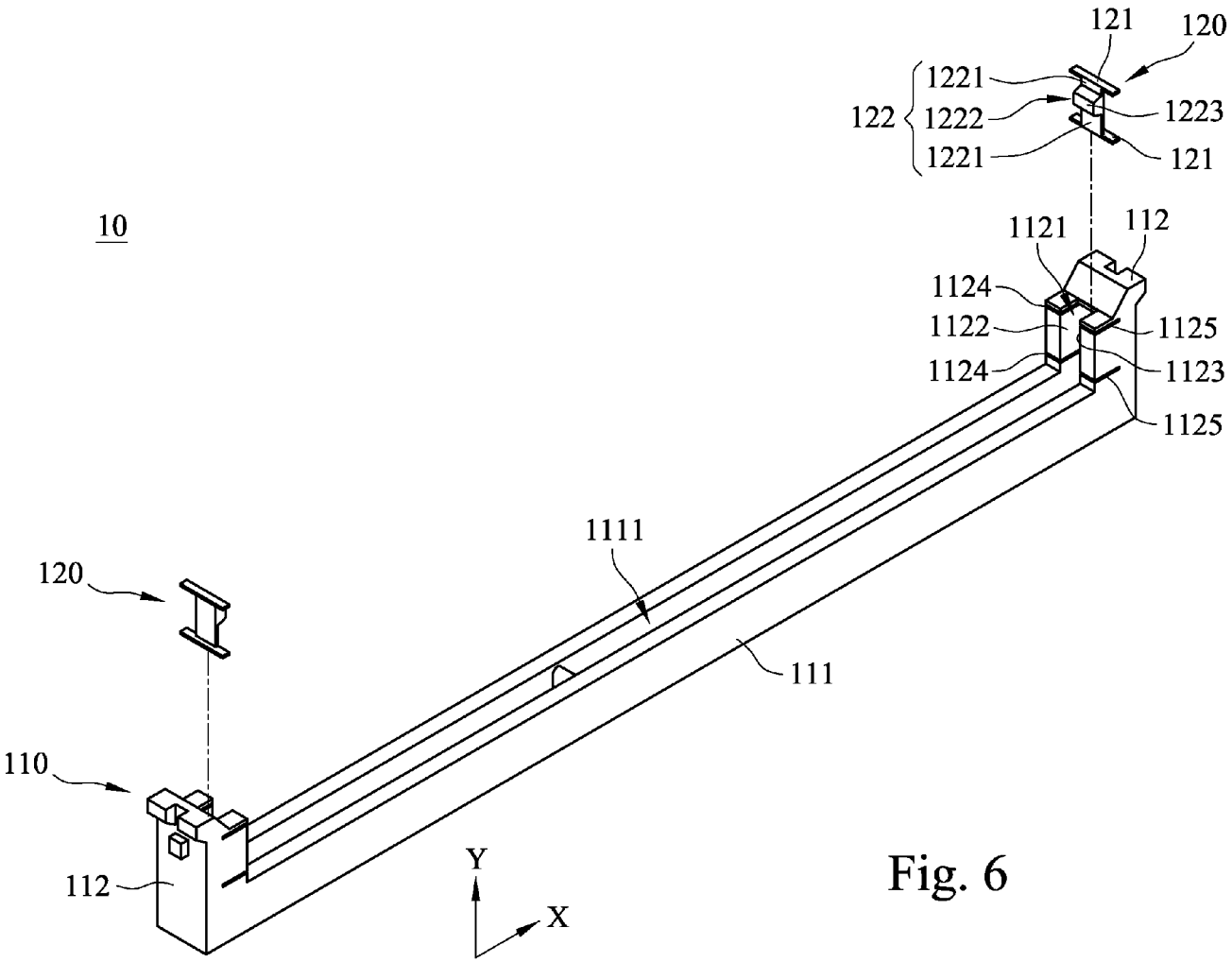
FIG. 6 is an explosive view of the second embodiment.
Figure 7:
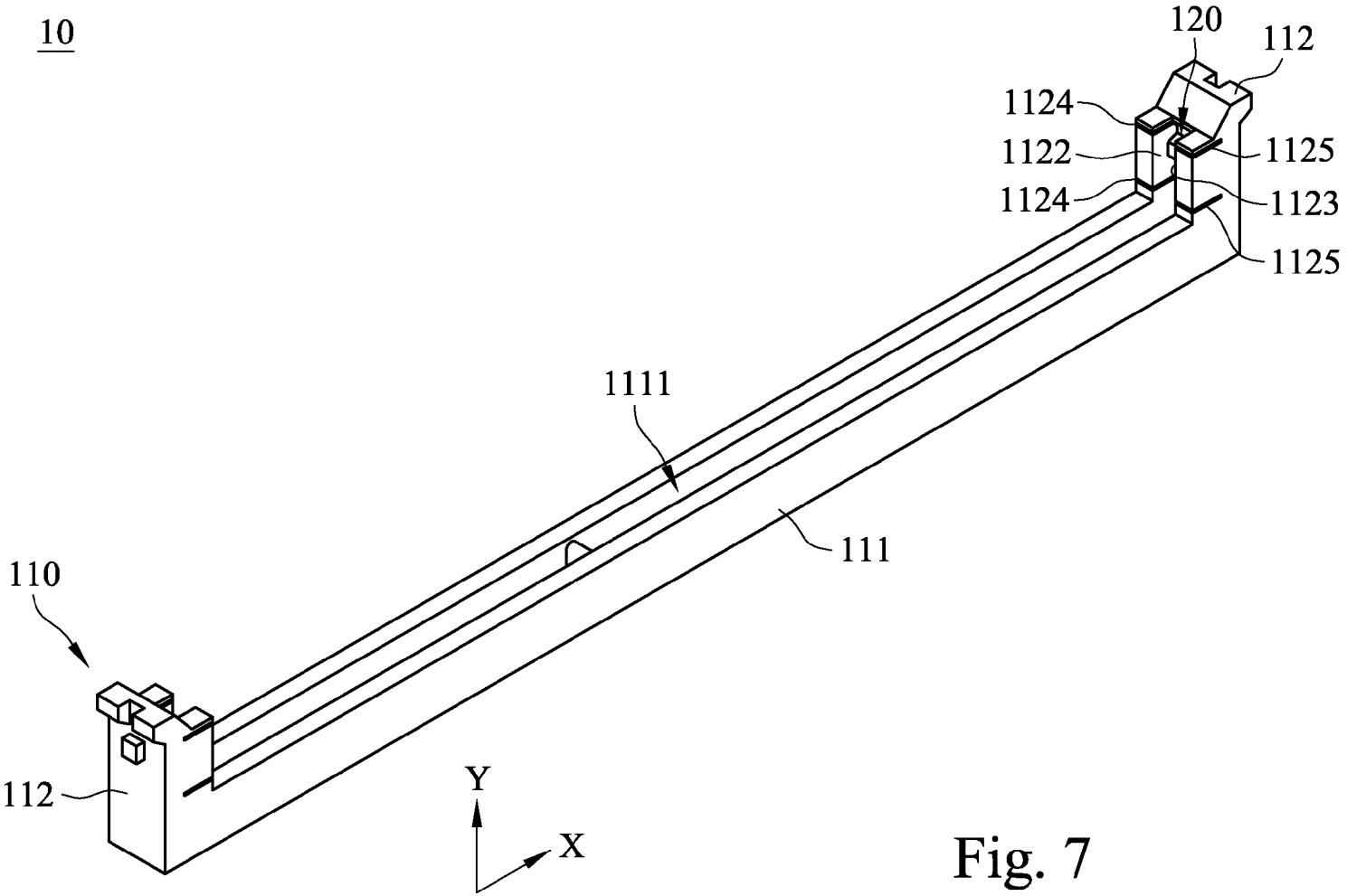
FIG. 7 is a cross-sectional view of the second embodiment.
Figure 8:
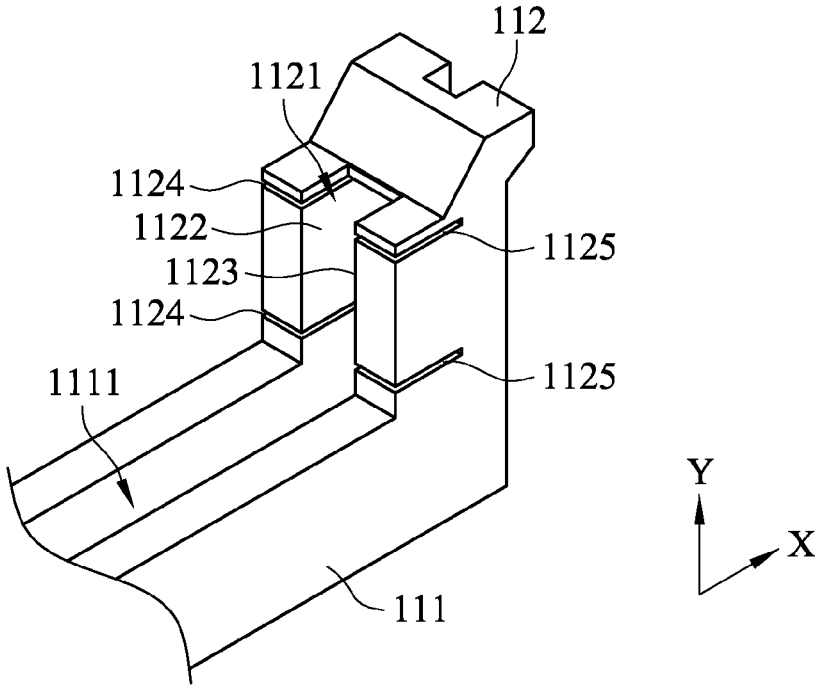
FIG. 8 is a partial enlarged view of FIG. 6.
Figure 9:
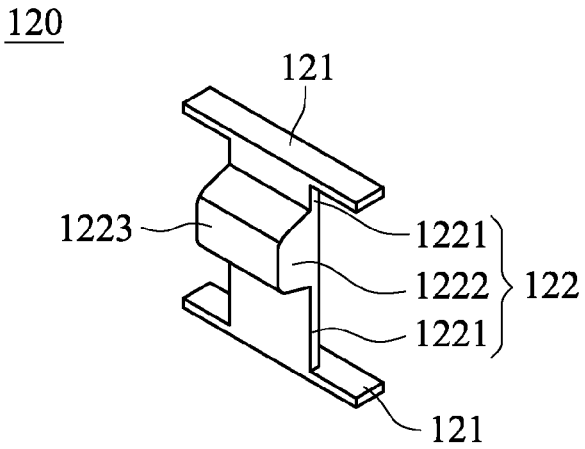
FIG. 9 is a perspective view of the latch according to the second embodiment.
Figure 10:
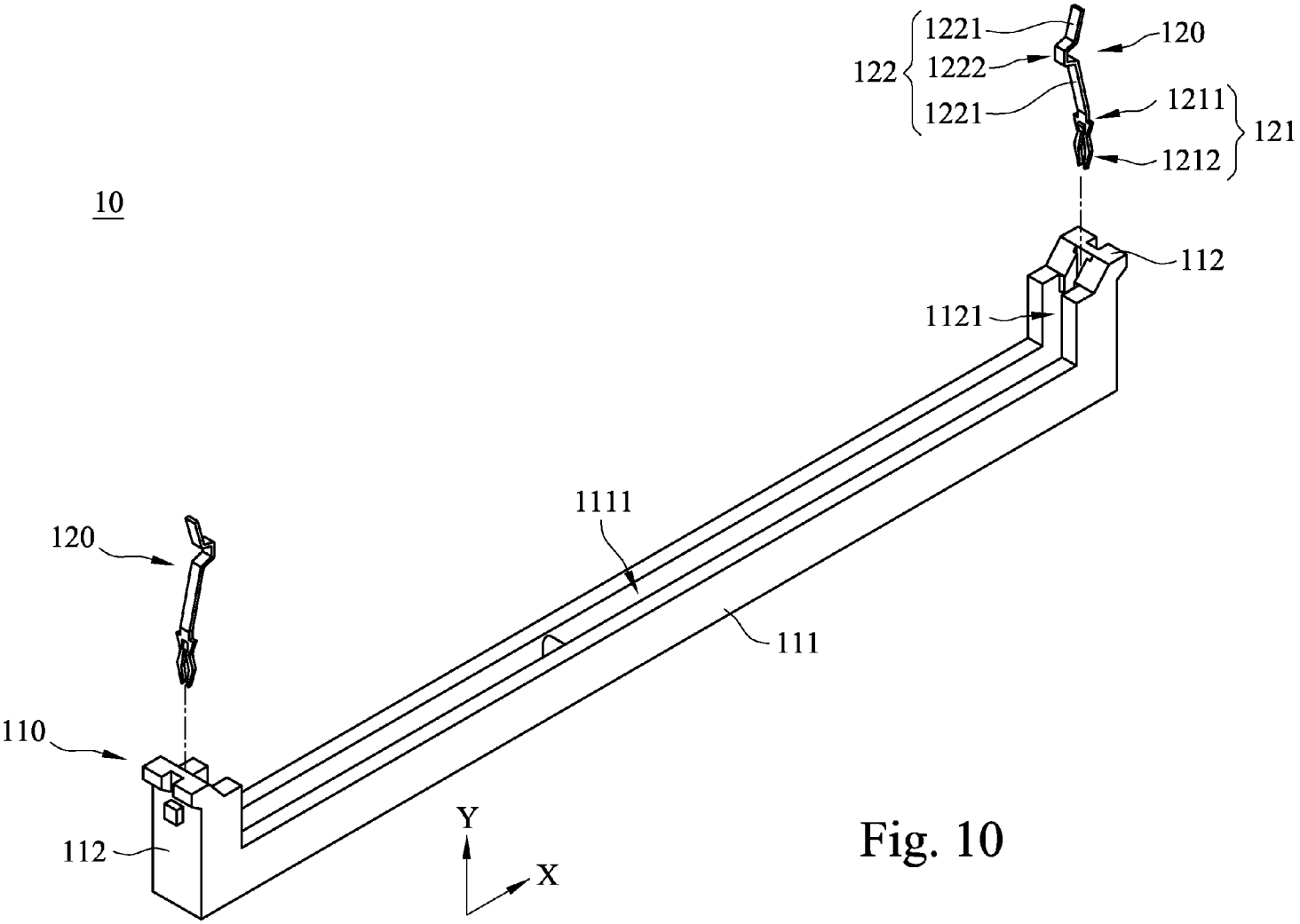
FIG. 10 is an explosive view of the third embodiment.
Figure 11:
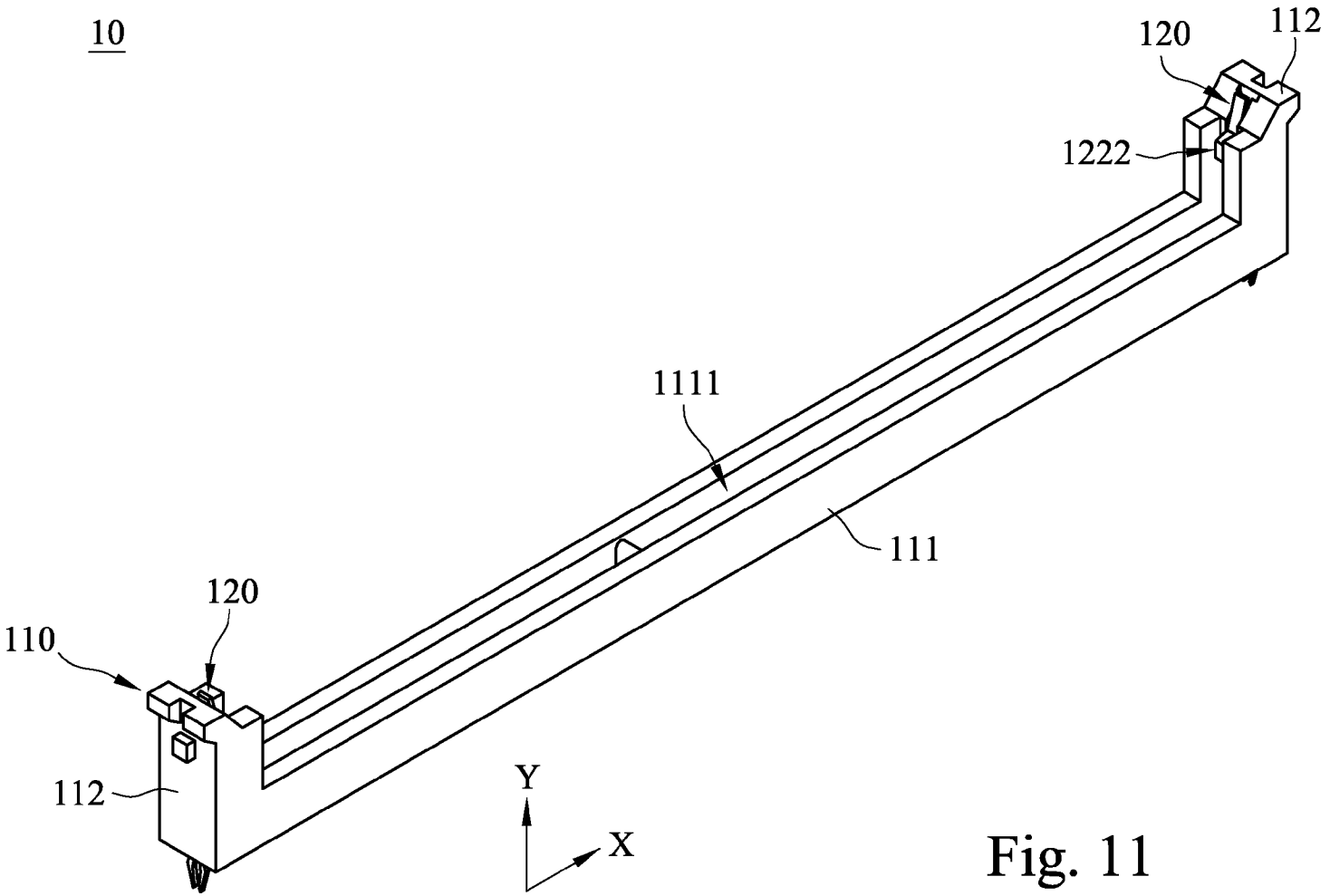
FIG. 11 is a perspective view of the third embodiment.
Figure 12:
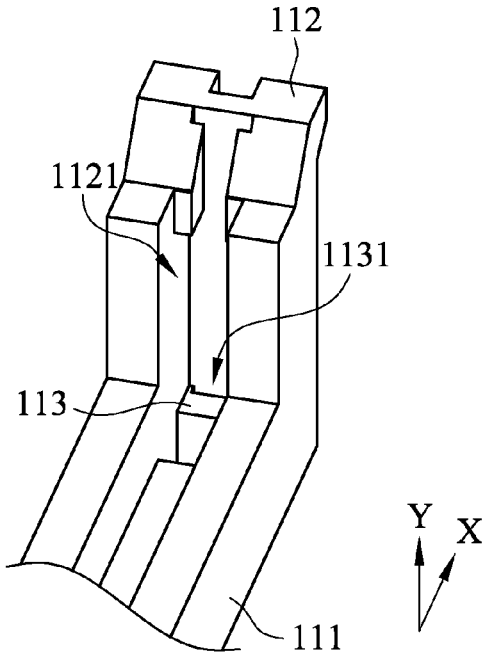
FIG. 12 is a partial enlarged view of FIG. 11.
Figure 13:
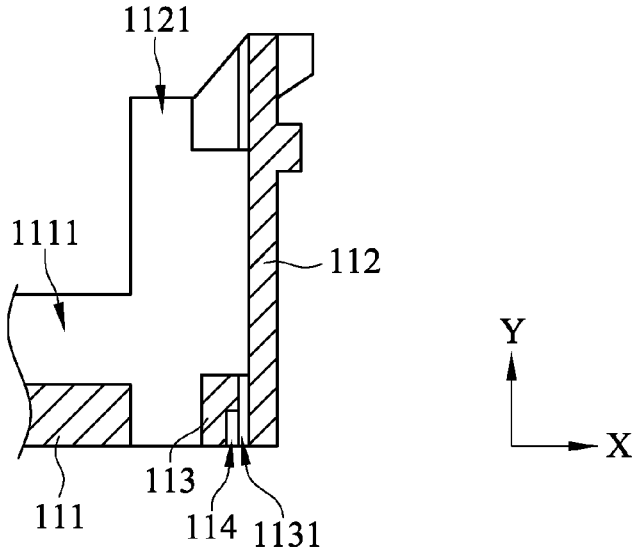
FIG. 13 is a perspective view of the body according to the third embodiment.

Referring to FIG. 6 and FIG. 8, a card edge connector 10 according to a second embodiment includes a body 10 and two latches 120. The body 110 includes a base 111 and two columns 112. The base 111 is, but not limited to, a long-narrow shaped structure. The base 111 includes an insertion slot 1111 formed thereon and the insertion slot 1111 is depressed on the upper surface of the base 111. Furthermore, the insertion slot 1111 extends in a first direction x which is parallel to a longitudinal axis of the base 111. The two columns 112 are disposed on the surface which the insertion slot 1111 is formed thereon. The two columns 112 are located in the first direction x, spaced by the insertion slot and respectively located adjacent to each end of the insertion slot 1111. Each of the columns 112 includes a trench 1121 formed on a surface adjacent to the insertion slot 1111. Each of trenches 1121 extends toward the base 111 in a second direction y to connect the insertion slot 111. Furthermore, each of the columns 112 includes a first wall surface 1122 and a second wall surface 1123 facing each other with the trench 1121 located therebetween. Two assembling holes 124 are formed on the first wall surface 1122, and two assembling holes 124 are disposed along the second direction y and spaced from each other. Two assembling holes 124 are formed on the first wall surface 1122 and pass through the column 112, and the assembling holes 1125 on the second wall surface 1123 are paired with a corresponding assembling hole 1124 on the first wall surface 1122. Furthermore, the assembling holes 1124 on the first wall surface 1122 and the assembling holes 1125 on the second wall surface 1123 respectively extend along the first direction x and expose on the surface of the column 112 adjacent to the insertion slot 1111.

Referring to FIG. 6 to FIG. 9, the two latches 120 of the card edge connector 10 are respectively disposed to the two columns 112 of the body 110. The latches 120 are, but not limited to, made of metal. Each of the latches 120 includes two fasten portions 121 and an elastic arm 122 connecting to the two fasten portions 121. Two opposite ends of each fasten portion 121 protrudes from two opposite edges of the elastic arm 122. An engaging portion 1222 is disposed on the surface of the elastic arm 122. Each of the engaging portions 1222 is, but not limited to, a bump or emboss on the surface of the elastic arm 122. The surfaces of engaging portion 1222 corresponding to the fasten portions 121 are curved surfaces or inclined surfaces to serve as guiding surfaces 1223.

When installing the card edge connector 10, the latch 120 move in the first direction x to insert two opposite ends of the each fasten portion 121 into the assembling hole 1224 on the first wall surface 1122 and the assembling hole 1125 on the second wall surface 1123 in a tight fit manner, and the two opposite ends of the fasten portion 121 move to the bottoms of the assembling hole 1124, 1125. The elastic arm 122 connects to the two fasten portions 121 in the second direction y and located between two fasten portions 121, and the elastic arm 122 suspends in the trench 1121.

When inserting the circuit board of the expansion device into the card edge connector or pulling the circuit board from the card edge connector, the opposite edges of the circuit board press the elastic arms 122 of the two latches 120 as the opposite edges of the circuit board of the expansion component press against the engaging portions 1222. Therefore each of the elastic arms 122 deforms toward the bottom of the trench 1121 of the column 112 in the first direction x, and the engaging portion 1222 embeds into or is removed from the notches on the opposite edges of the circuit board, so as to combine the expansion component with the card connector or remove the expansion component from the card edge connector.

Referring to FIG. 10 to FIG. 13, the card edge connector 10 according to a third embodiment includes a body 110 and two latches 120. The body is, but not limited to, monolithically made of insulation material. The body 110 includes a base 111 and two columns 112. The base 111 is, but not limited to, a long-narrow shaped structure. The base 111 includes an insertion slot 1111 formed thereon and the insertion slot 1111 is depressed on the upper surface of the base 111. Furthermore, the insertion slot 1111 extends in a first direction x which is parallel to a longitudinal axis of the base 111.

The two columns 112 are disposed on the surface which the insertion slot 1111 is formed thereon. The two columns 112 are respectively located at two ends of the base 111 and in the first direction x, such that the insertion slot 1111 is located between the two columns 112.

Each of the columns 112 includes a trench 1121 formed on a surface adjacent to the insertion slot 1111. Each of the trenches 1121 extends in a second direction y to connect the insertion slot 111 of the base 111. The first direction x and the second direction y are intersect, for example, the first direction x is perpendicular to the second direction y, or an included angle are defined by the two directions. Each of the columns 112 includes a connecting portion 113 disposed in the trench 1121. The connecting portion 113 includes a channel 1131 passing through the connecting portion 113, and the channel 1131 connects to the trench 1121 of the column 112. Furthermore, the body 110 includes two apertures 114 on another side surface opposite the two columns 112. The two apertures 114 respectively corresponds one of the connecting portions 113, and connects to the channel 1131 of the connecting portion 113.

Referring to FIG. 10, FIG. 11, FIG. 14A, and FIG. 14B, the two latches 120 of the card edge connector 10 are respectively disposed to the two columns 112 of the body 110 and located in the trenches 1121 of the two columns 112. Each of the latches 120 includes two fasten portions 121 and an elastic arm 122. The latch 120 or at least the elastic arm 122 thereof is made of material having elastic recovery property, for example, the elastic recovery material is plastic, rubber, metal . . . etc. In this embodiment, the latch 120 formed monolithically a made of metal is taken as an illustration, and the implement is not limited thereto.

The elastic arm 122 of the latch 120 includes a first end 1211 and a second end 1212. A stopping portion 1213 is disposed at the first end 1211 of the fasten portion 121. The stopping portion 1213 is, but not limited to, a bump, emboss, or reed disposed on the surface of the first end 1211. In this embodiment, the stopping portion 1213 is illustrated by a reed extending from the first end 1211 of the fasten portion 120. One end of the stopping portion 1213 connects to the first end 1211 of the fasten portion 121, and the other end of the stopping portion 1213 is inclined from the second end 1212 to the first end 1211 and spaced from the first end 1211, such that the stopping portion 1213 is able to move back and forth with respect to the first end 1211.

The second end 1212 of the fasten portion 121 includes two insertion pins 1215. The two insertion pins 1215 are connected to the fasten portion 1211 and spaced from each other. And the two insertion pins 1215 selectively keep close to each other or separate from each other. The two insertion pins respectively includes an inflection point, and the two inflection points bent to reverse directions. The interval distance between the two inflection points of the insertion pins 1215 are normally larger than the width of the first end 1211 of the fasten portion 1211. When the two insertion pins 1215 are driven to keep closed to each other, the interval distance are smaller than the width of the first end 1211 of the fasten portion 121. It is noted that two insertion pins 1215 included within the second end 1212 is an illustration of this embodiment, in other embodiment of this disclosure, such as that shown in FIG. 15A and FIG. 15B, the second end 1212 of the fasten portion 121 is selected, according to actual requirement, from a plate or a cylinder connecting the first end 1211 of the fasten portion 121, the aforementioned types of the second end 1212 are illustration, not a limitation of this disclosure.

The elastic arm 122 the latch 120 includes two straight portion 1221 and an engaging portion 1222. The elastic arm 122 connects to the first end 1211 of the fasten portion 121 through one of the straight portion 1221, and an included angle θ larger than 90 degree and smaller than 180 degree is defined between the elastic arm 122 and the fasten portion 121. The engaging portion 1222 of the elastic arm 122 connects to the two straight portions 1221 and located therebetween. The engaging portion 1222 is, but not limited to, a bent structure bent on one of the straight portions 1221 and extending toward another straight portion 1211, such that the engaging portion 1222 includes a height on the elastic arm 122 with respect to the two straight portions 1221.

Referring to FIG. 10, FIG. 11, FIG. 14A, FIG. 16, and FIG. 17, when installing the card edge connector 10, The fasten portions 121 of the two latches 120 respectively penetrate two connecting portions 113 of the body 110, the first end 1211 of the fasten portion 121 is fixed in the channel 1131 of the connecting portion 113, and the second end 1212 of the fasten portion 121 penetrates the body 110 and exposes outside the body 110. When the fasten portion 121 of the latch 120 penetrate the body 110 in the second direction y via the channel 1131 of the connecting portion 113 and travels a proper distance, with the included angle θ between the elastic arm 122 and the first end 1211, the straight portion 1221 connecting to the fasten portion 121 presses the surface of the connecting portion 113 of the body 110, so as to restrict the movement of the latch 120 toward the connecting portion 113 in the second direction y. Meanwhile, the elastic arm 122 suspends in the trench 1121 of the column 112, and the elastic arm 122 tilts toward the trench 1111 of the body 110. When external force apply to the elastic arm 122, the elastic arm 122 deforms in the trench 1121 in the first direction x, so as to drive the engaging portion to move back and forth in the trench 1121 in the first direction x.

Figure 17:
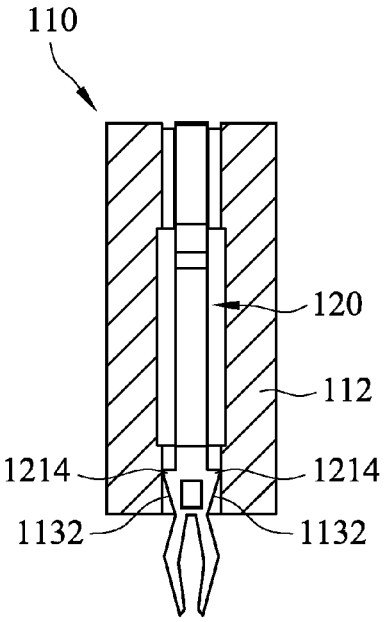
FIG. 17 is a cross-sectional view of the third embodiment.

Furthermore, When the fasten portion 121 of the latch 120 penetrates the body 110, the stopping portion 1212 of the fasten portion 121 is pressed to deform in the channel 1131 of the connecting portion 113 as the first end 1213 passes through the connecting portion 113 of the body 110. And then, the stopping portion 1213 recovers to original state in the aperture 114 by elastic recovery property after the stopping portion 1212 arrives at a position where the channel 1131 of the connecting portion 113 connects to the aperture 114 of the body 110. The stopping portion 1213 also presses against a wall of the aperture 114 adjacent to the connecting portion 113. In other word, the stopping portion 1213 presses against on the of the connecting portion 113 corresponding the trench 1121, so as to restrict the movement of the latch 120 toward the trench 1121 of the column 112 in the second direction y. Referring to FIG. 17, the fasten portion 121 of the latch 120 and the elastic arm 122 are respectively clamped by two opposite sides of the connecting portion 113, so as to restrict the movement of the latch 120 toward the connecting portion 113 in the second direction y and securely fix the latch 120 on the body 110.

Figure 14B:
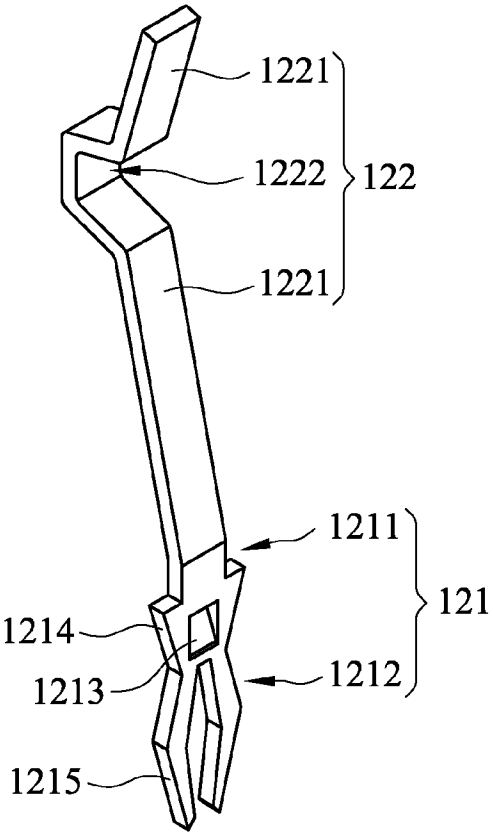
FIG. 14A, FIG. 14B, FIG. 15A, and FIG. 15B are perspective views of the latch according to the third embodiment.
Figure 14A:
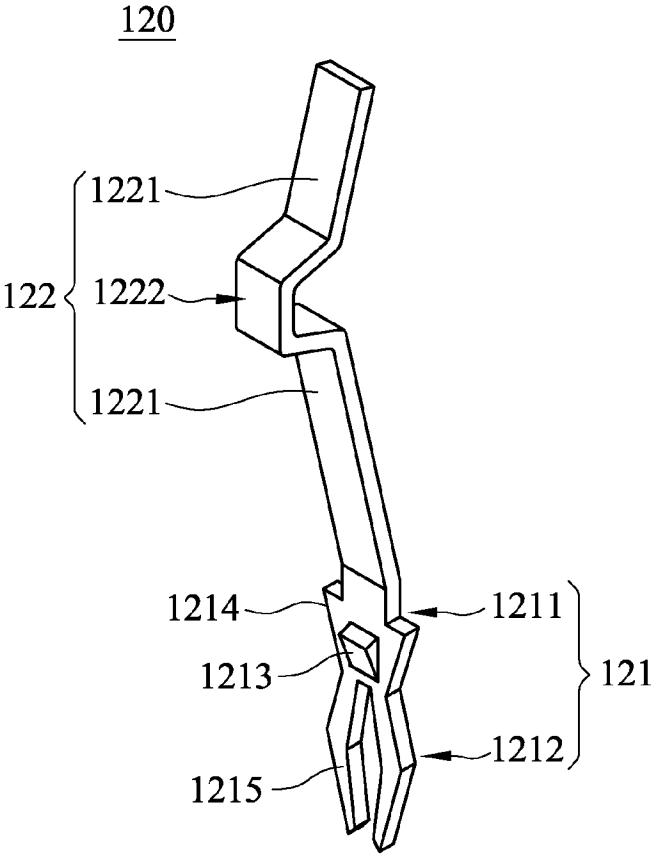
Figure 16:
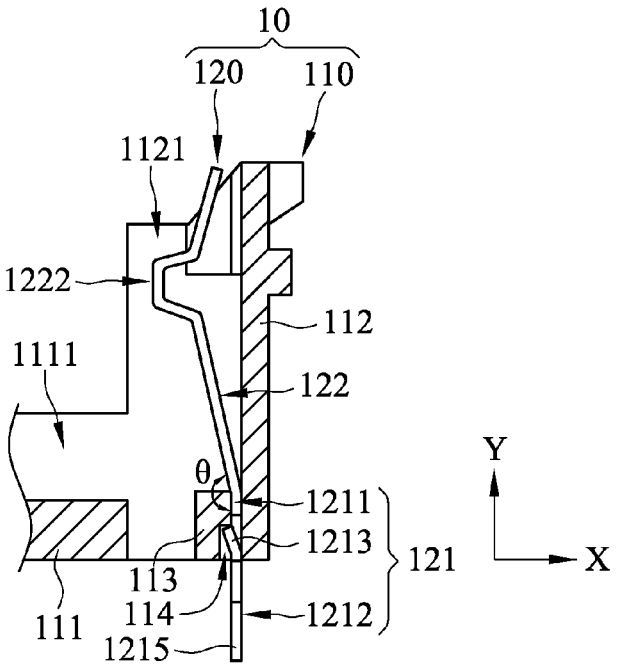
FIG. 16 is a perspective view of the third embodiment.

Referring to FIG. 14A, FIG. 16, FIG. 17, to more securely fix the latch 120 on the body 120, a limiting portion 1214 is disposed on the fasten portion 121 of the latch 120 and a pressing surface 1132 is correspondingly disposed on the connecting portion 113 of the body 110. In one example of this disclosure, one limiting portion 1214 is disposed to one side of the first end 1211 of the latch 120; in another example, two limiting portions 1214 are respectively disposed to opposite sides of the first end 1211. The pressing surface 1132 of the body is disposed inside the channel 1131 of the connecting portion 113, and the configuration of the pressing surface 1132 matches the configuration of the limiting portion 1214. For example, the pressing surface 1132 is an inclined surface while the limiting portion 1214 is a structure with an inclined edge formed on the first end 1211 of the latch 120.

When the fasten portion 121 of the latch 120 pass through the connecting portion 113 of the body 110 and travels a proper distance, the limiting portion 1214 of the fasten portion 121 presses against the pressing surface 1132 of the connecting surface 1232, so as to restrict the movement of the latch 120 toward the connecting portion 113 in the second direction y and securely fix the latch 120 on the body 110.

It is noted that the limiting portion 1214 of the latch 120 can be a bump or an emboss disposed on the elastic arm 122 adjacent to the fasten portion 121; in other word the limiting portion 1214 is disposed at the conjunction of the straight portion 1221 of the elastic arm 122 and the first end 1211 of the fasten portion 121. When the fasten portion 121 of the latch 120 pass through the connecting portion 113 of the body 110, the limiting portion 1214 of the latch 120 presses against the pressing surface 1132 of the connecting surface 1232, that is a lateral surface of the connecting portion 113 facing the trench 1121 serves as a pressing surface, so as to restrict the latch 120 within the trench 1121 and prevent the fasten portion 121 from moving outward after the fasten portion 121 of the latch 120.

Through the limiting structure implemented by the limiting portion 1214 of the latch 120 and the connecting portion 113 pressing against each other, the latch 120 is fixed on the body 120 more securely. Therefore, the position and the configuration of the limiting portion 1214 of the latch 120 match the position and the configuration of the connecting portion 113 of the body 110, and the positions and the configurations can be varied according to actual requirement without limitation in the above-mentioned embodiments.

Figure 15B:
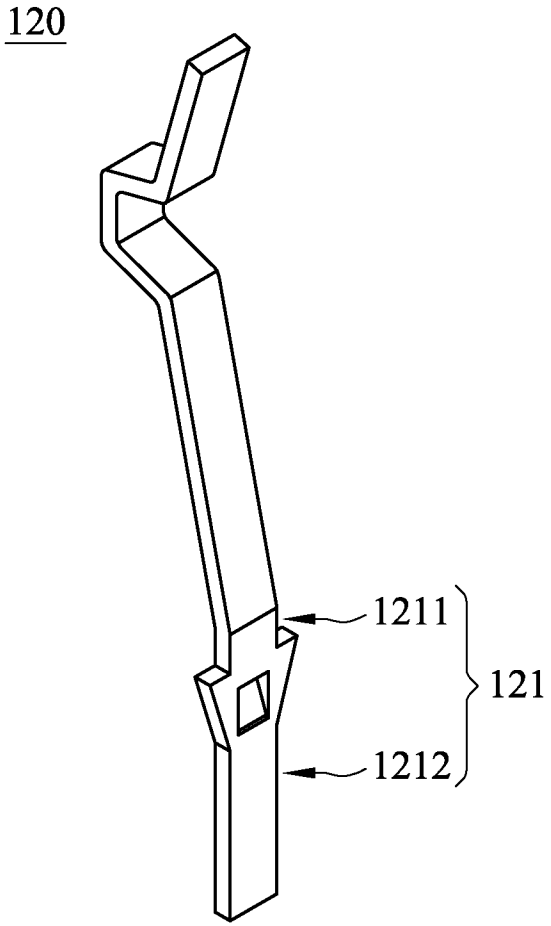
Figure 15A:
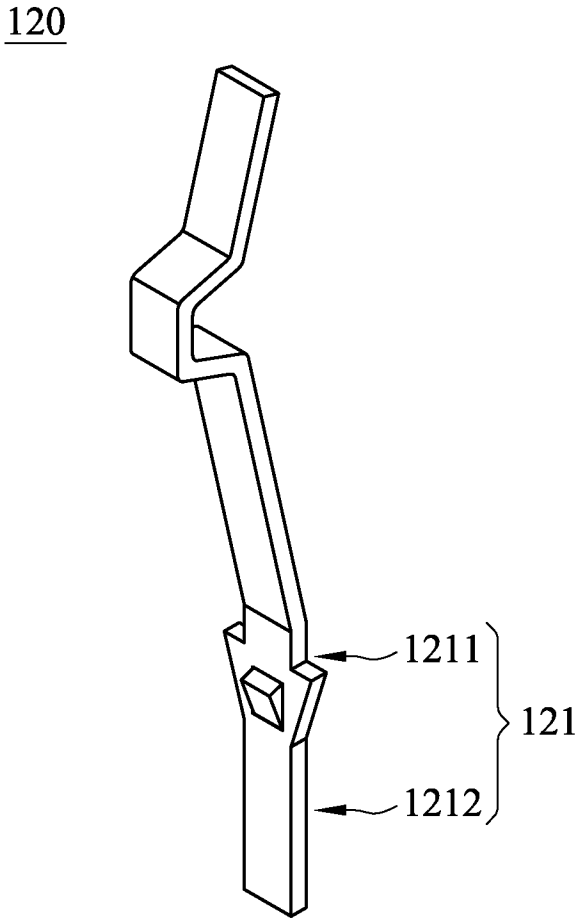
Figure 18:
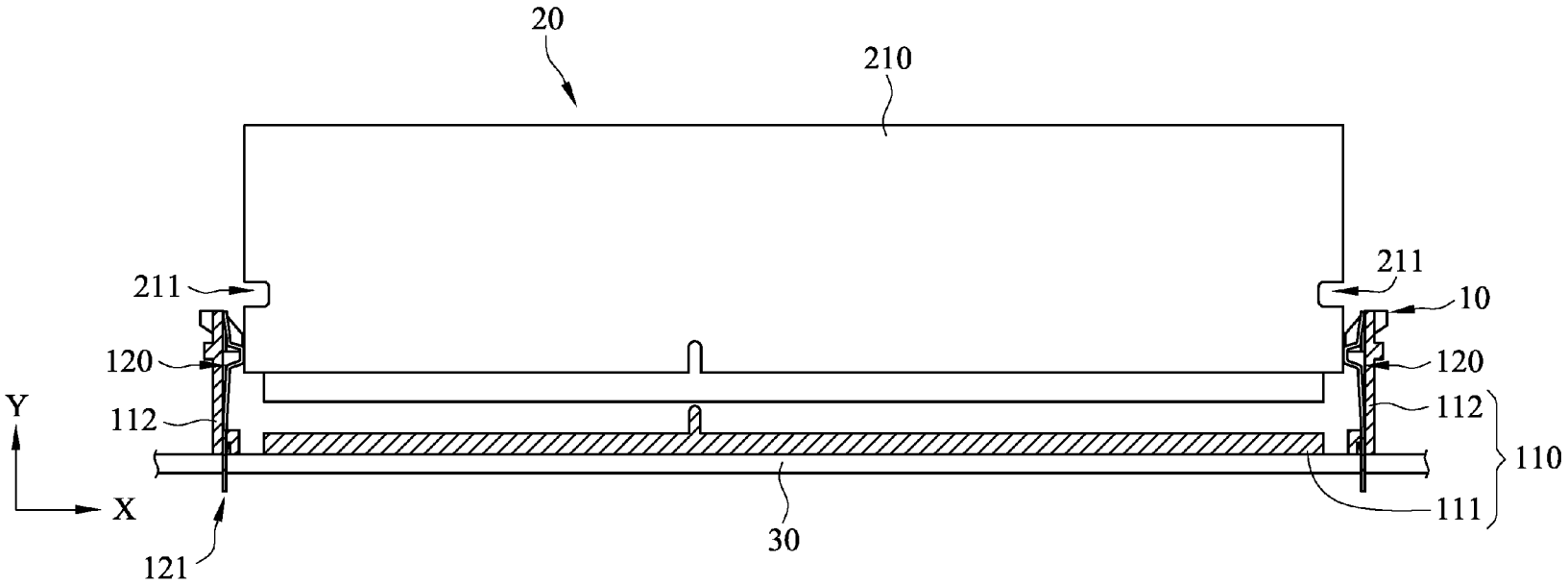
FIG. 18 and FIG. 19 are schematic views illustrating operation of the first embodiment.
Figure 19:
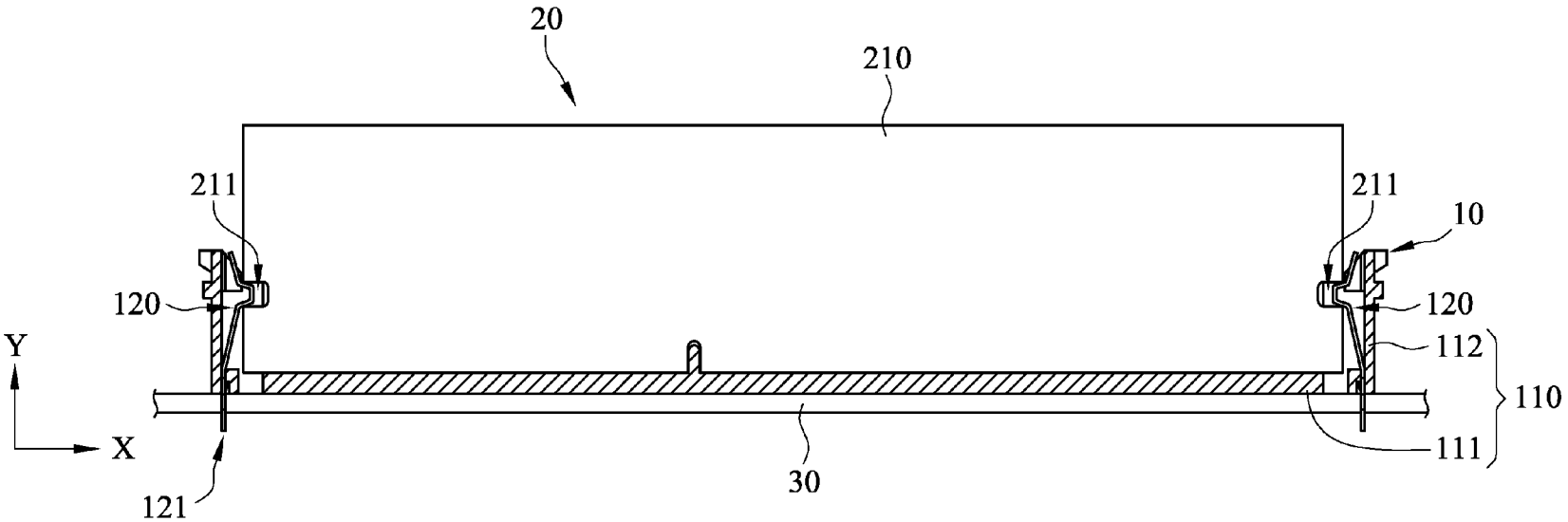

Referring to FIG. 16, FIG. 18, and FIG. 19, when installing the card edge connector 10 to the main board 30, the fasten portions 121 of the two latches 120 pass through corresponding assembling holes (not shown in the figures) of the main board 30 and then the body 110 of the card edge connector 10 presses against the surface of the main board 30 and the horizontal movement of the body 110 on the main board 30 is restricted. It is noted that the card edge connector 10 can be mounted on the main board 30 through SMT (Surface Mount Technology) or DIP (Direct Insertion Process). When utilizing SMT, a latch 120 with the second end 1212 configured in a plate or a cylinder is preferred (as shown in FIG. 15A and FIG. 15B), so as to align the latch 120 on the main board 30 through the fasten portion 121. When utilizing DIP, a latch 120 with the second end 1212 configured in two insertion pins 1215 is preferred (as shown in FIG. 14A and FIG. 14B). After the fasten portion 121 penetrates the main board 30, two insertion pins 1215 press against the inner wall of the assembling hole of the main board 30 to temporarily align and fix the body 110 of the card edge connector 10 on the main board 30.

Referring to FIG. 11, FIG. 16, FIG. 18, and FIG. 19, after disposing the card edge connector 10 on the main board 30, the expansion component 20 is able to insert into the card edge connector 10. The expansion component 20 includes a circuit board 10, and each of the opposite edges of the circuit board 210 includes a notch 211 formed thereon. Two opposite edges of the circuit board 210 respectively embed into trenches 1121 of the columns 112 and then the circuit board 210 is guided by the trenches 1121 to insert into the insertion slot 1121. Meanwhile, the opposite edges of the circuit board 210 respectively press against the engaging portions 1222 of the two latches 120. And then the circuit board 210 moves toward the insertion slot 1111 of the base 111, the opposite edges of the circuit board 210 continuously press against the engaging portions 1222 to deform the elastic arms 122, so as to drive engaging portions 1222 of the twp latches 120 in the first direction x and enlarge the interval distance between the two latches 120.

After one edge of the circuit board 210 inserts into the insertion slot 1111 of the base 111, the notches 211 of the opposite edges of the circuit board 210 are located corresponding to the engaging portions 1222 of the elastic arms 122. Since force applied to the engaging portions 1222 is removed, the engaging portions 1222 reset to the original positions by elastic recovery force of the elastic arms 122 and the engaging portions 1222 respectively engages into the notches 211 of the circuit board 210. By the restriction of the two latches 120, the circuit board 210 is not able to escape from the card edge connector 10. Similarly, when the detaching the expansion component 20 from the card edge connector 10, the opposite edges of the circuit board 210 press against the engaging portions 1222 of the elastic arms 122 when pulling the expansion component 20, so as to enlarge the interval distance between the engaging portions 1222 of the two latches 120 and release engaging portions 1222 from notches 211 of the circuit board 210. And then the circuit board 210 of the expansion component 20 escapes from the card edge connector 10 in the second direction y.

According to the above description, when the expansion component inserts into the card edge connector, the expansion component 20 is restricted or released by the engaging portions 1222 moving parallel to the longitudinal axis of the base 110 reciprocally, the latches are not required to be pressed or rotated by the user when inserting the expansion component into the card edge connector or pulling the expansion component away from the card edge connector, therefore the installation procedure of the expansion component is simplified. Beside, reserved space inside the electronic device for rotating or swiveling the latch is not required anymore, space usage efficiency inside the electronic device is improved and it becomes easier to minimize the size of the electronic device. Moreover, through the fasten portion of the latch penetrating the body to serve as a align structure of the body, the latch align and fix the card edge connector on the main board, such that the installation of the card edge connector become simpler and more convenient.

Figure 20:
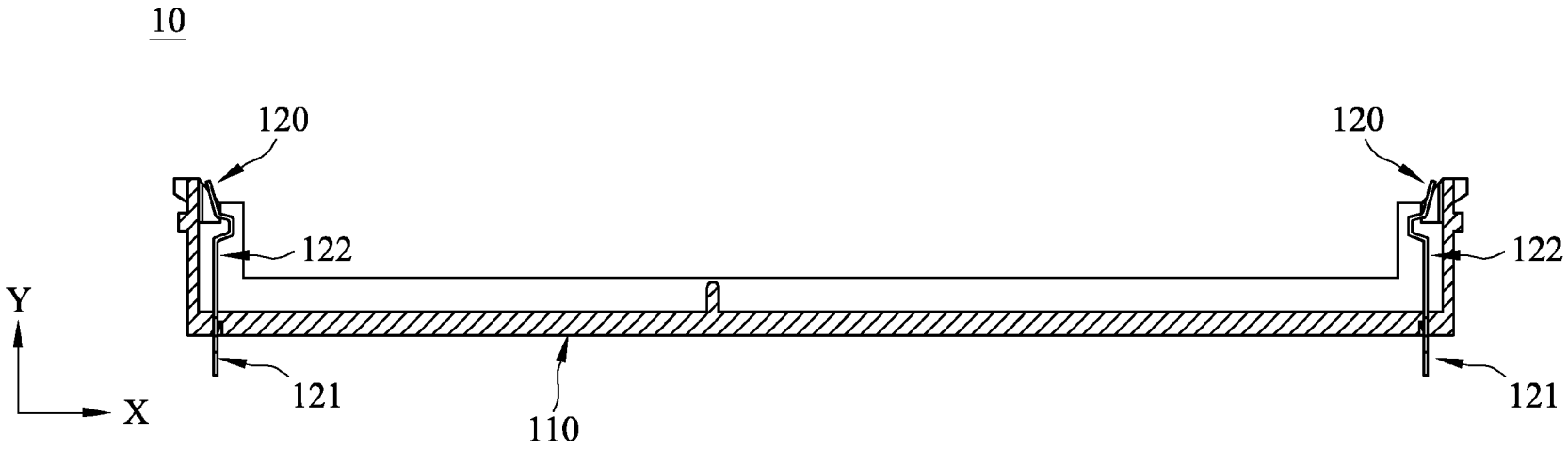
FIG. 20 is a cross-sectional view of the fourth embodiment.

Referring to FIG. 20, the card edge connector 10 fourth embodiment is similar to that in the third embodiment, the differences lie in that the elastic arm 122 of the latch 120 according to the fourth embodiment connects to the fasten portion 121 in a straight manner instead connecting in an inclined manner. Meanwhile, after the fasten portion 121 of the latch 120 penetrates the body 110, the first end of the fasten portion 121 is fixed to the connecting portion 121 of the body 110 through welding or adhering. Or the width of the latch 120 or at least the width of the fasten portion 121 of the latch 120 matches the width of the channel of the connecting portion, such that the fasten portion 121 of latch 120 combines with the body 110 in a tight fit manner to restrict the movement of the latch 120 in the second direction y and limiting structure such as the stopping portion or the limiting portion can be omitted.

Therefore, by the fasten portion 121 of the latch 120 fixed on the body 110, the elastic arm 122 of the latch 120 moves back and forth in the first direction x by elastic recovery property, so as to clamp or release the expansion component.

Furthermore, beside tight fit, the fasten portion of the latch can combine with the assembling holes of the column through other implementing means. For example, at least one of the assembling holes is configured with a stopping portion formed therein and a limiting portion corresponding to the stopping portion is disposed on the fasten portion of the latch. The limiting portion and the stopping portion are, but not limited to, the combination of a protruding structure and a depressed structure. For example, the limiting portion is emboss, bump, or rib extending from the fasten portion of the latch while the stopping portion is a depression formed on an inner wall of the assembling hole, and vice versa. Through combination of a protruding structure and a depressed structure, the limiting portion of the fasten portion combines with the stopping portion in the assembling hole to restrict the movement of the latch in the first direction, so as to prevent the latch from fall from the column.

The configuration of the card edge connector is not limited by the configurations in the aforementioned embodiments, a person having ordinary skill in the art can made necessary modification for the elastic arms and engaging portions in the card edge connector of this disclosure to satisfy requirement of product design or user's operation.

When the expansion component 20 inserts into the card edge connector 10, the latches are not required to be pressed or rotated by the user when inserting the expansion component into the card edge connector or pulling the expansion component away from the card edge connector. Not only the installation for the expansion component is simplified, the usage efficiency of the inner space of the electronic device is enhanced to assist the minimization development of the electronic device. Furthermore, To install the card edge connector to the main board, the fasten portion of the latch align the card edge connector on the main board at first, and then the card edge connector is fixed to the main board, so as to prevent displacement of the card edge connector from occurring when fixing the card edge connector on the main board and increase the reliability of the production.

The present invention has been disclosed as mentioned-above and it is understood the embodiments are not intended to limit the scope of the present invention. Moreover, as the contents disclosed herein should be readily understood and can be implemented by a person skilled in the art, all equivalent changes or modifications which do not depart from the spirit of the present invention should be encompassed by the appended claims.

What is claimed is:

1. A card edge connector, comprising:

a body, including:

a base, including an insertion slot extending along a first direction; and two columns, disposed on the base and located in the first direction, and respectively located at a position corresponding to two opposite ends of the insertion slot of the base; wherein each of the two columns includes a trench on a lateral surface, corresponding to the slot, of the column, and each trench extends toward the base in a second direction to connect to the insertion slot; and two latches, respectively disposed on the trenches of the two columns; wherein each of the latches includes at least one fasten portion and an elastic arm connecting to the fasten portion, the fasten portion is fixed to the column, the elastic arm is accommodated in the trench, the elastic arm includes an engaging portion on a lateral surface, corresponding to the insertion slot, of the elastic arm, and the engaging portion is applicable to move back and forth with respect to the column in the first direction, wherein each fasten portion includes a first end and a second end, the first end penetrates through the body, the second end exposes outside the body, and the elastic arm connects to the first end of the fasten portion, wherein the body further includes two connecting portions, the two connecting portions are respectively disposed in the two trenches of the two columns, each of the connecting portions includes a channel extending in the second direction on the connecting portion, the fasten portion of each of the latches penetrates through the body via the channel, and the first end of the fasten portion is fixed in the channel, wherein the fasten portion further includes a stopping portion, the stopping portion connects to the first end of the fasten portion and protrudes on the surface of the first end, and the stopping portion of the fasten portion presses against the other lateral side of the connecting portion which is opposite to the trench.

2. The card edge connector as claimed in claim 1, wherein the elastic arm further includes two straight portions, wherein the engaging portion is located between two straight portions, and each straight portion is located between the engaging portion and the fasten portion.

3. The card edge connector as claimed in claim 2, wherein the engaging portion is a bent structure extending from the two straight portions.

4. The card edge connector as claimed in claim 2, wherein each engaging portion includes a guiding surface in between and adjacent to the two straight portions.

5. The card edge connector as claimed in claim 1, wherein the width of the elastic arm is smaller than the width of the trench of the column.

6. The card edge connector as claimed in claim 1, wherein the elastic arm of each of the latches connects to the first end of the elastic arm in a tilt manner.

7. The card edge connector as claimed in claim 1, wherein an aperture is formed on the other lateral side of the trench opposite the two columns of the body, the aperture corresponds to the connecting portion and connects to the channel of the connecting portion, and the stopping portion of the fasten portion presses against a wall surface of the connecting portion adjacent to the aperture.

8. The card edge connector as claimed in claim 1, wherein two insertion pins are disposed on the second end of the fasten portion, the two insertion pins are connected to the first end of the fasten portion and spaced from each other, and the two insertion pins selectively keep close to each other or separate from each other.

9. A card edge connector, comprising:

a body, including:

a base, including an insertion slot extending along a first direction; and two columns, disposed on the base and located in the first direction, and respectively located at a position corresponding to two opposite ends of the insertion slot of the base; wherein each of the two columns includes a trench on a lateral surface, corresponding to the slot, of the column, and each trench extends toward the base in a second direction to connect to the insertion slot; and two latches, respectively disposed on the trenches of the two columns; wherein each of the latches includes at least one fasten portion and an elastic arm connecting to the fasten portion, the fasten portion is fixed to the column, the elastic arm is accommodated in the trench, the elastic arm includes an engaging portion on a lateral surface, corresponding to the insertion slot, of the elastic arm, and the engaging portion is applicable to move back and forth with respect to the column in the first direction, wherein each fasten portion includes a first end and a second end, the first end penetrates through the body, the second end exposes outside the body, and the elastic arm connects to the first end of the fasten portion, wherein the body further includes two connecting portions, the two connecting portions are respectively disposed in the two trenches of the two columns, each of the connecting portions includes a channel extending in the second direction on the connecting portion, the fasten portion of each of the latches penetrates through the body via the channel, and the first end of the fasten portion is fixed in the channel, wherein a pressing surface is disposed in the channel of the connecting portion and each of the latches further includes a limiting portion pressing against the pressing surface of the connecting portion.

10. The card edge connector as claimed in claim 9, wherein the pressing surface is an inclined surface, and the limiting portion of the fasten portion is a inclined structure matching the pressing surface.

* * * * *